US008196676B2

(12) United States Patent
Rubie

(10) Patent No.: US 8,196,676 B2
(45) Date of Patent: Jun. 12, 2012

(54) RECOILLESS HAMMER

(75) Inventor: Peter John Rubie, Toowoomba (AU)

(73) Assignee: Russell Mineral Equipment Pty. Ltd., Toowoomba (AU)

( * ) Notice: Subject to any disclaimer, the term of this patent is extended or adjusted under 35 U.S.C. 154(b) by 294 days.

(21) Appl. No.: 12/673,118

(22) PCT Filed: Aug. 13, 2008

(86) PCT No.: PCT/AU2008/001166

§ 371 (c)(1),
(2), (4) Date: Feb. 11, 2010

(87) PCT Pub. No.: WO2009/021282

PCT Pub. Date: Feb. 19, 2009

(65) Prior Publication Data

US 2011/0315418 A1 Dec. 29, 2011

(30) Foreign Application Priority Data

Aug. 13, 2007 (AU) ..... 2007904333

(51) Int. Cl.
*B25D 9/02* (2006.01)

(52) U.S. Cl. ..... 173/212; 173/128; 173/135; 173/206

(58) Field of Classification Search ..... 173/210, 173/212, 128, 135, 138, 19, 206, 207, 91
See application file for complete search history.

(56) References Cited

U.S. PATENT DOCUMENTS

| | | | | | |
|---|---|---|---|---|---|
| 3,299,968 | A | * | 1/1967 | Cunningham | 173/135 |
| 4,100,976 | A | * | 7/1978 | Stone | 173/133 |
| 4,741,404 | A | * | 5/1988 | Oyama | 173/17 |
| 5,002,136 | A | * | 3/1991 | Barthomeuf | 173/114 |
| 5,210,918 | A | * | 5/1993 | Wozniak et al. | 29/254 |
| 5,520,254 | A | * | 5/1996 | Weber | 173/128 |
| 5,819,857 | A | * | 10/1998 | Rohrer | 173/90 |

(Continued)

FOREIGN PATENT DOCUMENTS

| | | |
|---|---|---|
| EP | 0181468 | 5/1986 |
| EP | 1690647 | 8/2006 |
| JP | 02/081152 | 10/2002 |

OTHER PUBLICATIONS

PCT International Search Report dated Oct. 3, 2008.

*Primary Examiner* — Scott A. Smith
(74) *Attorney, Agent, or Firm* — McCarter & English, LLP

(57) ABSTRACT

A recoilless hammer comprising a moil supported for reciprocal movement along a hammer axis of a housing, a piston moveable within the chamber of an elongate tube extending from the rear of the housing such that it may strike the moil. In a rest position the piston is held forward against the moil by a low pressure air supply delivered from the aft end of the chamber, and the piston is retracted to a charged position at the aft end of the chamber by delivery of high pressure air to act on the fore portion of the piston. Upon actuation of a trigger mechanism, air is vented from the fore end of the chamber to atmosphere causing a pressure unbalance of low magnitude across the piston, such that it accelerates towards and strikes the moil. The chamber is of a length to enable a high energy blow with minimal piston acceleration recoil when the hammer is manually held and operated.

9 Claims, 3 Drawing Sheets

U.S. PATENT DOCUMENTS 5,944,120 A * 8/1999 Barden ..... 173/212
6,378,951 B1 * 4/2002 Bouyoucos et al. ..... 299/37.2
6,854,538 B2 * 2/2005 Muuttonen ..... 175/414
6,904,980 B2 * 6/2005 Rubie ..... 173/208
6,932,166 B1 8/2005 Kirsch
7,032,688 B2 * 4/2006 Kirsch ..... 173/212
7,252,158 B2 * 8/2007 Kirsch ..... 173/212

* cited by examiner

RECOILLESS HAMMER

TECHNICAL FIELD

The present invention relates to a pneumatically actuated recoilless hammer. In particular, the present invention relates to a high blow energy pneumatically actuated recoilless hammer that can be manually held and operated.

BACKGROUND

There are quite a few prior art rock breaking devices. The most basic device is a sledge hammer. An experienced "sledge hammer" operator can only achieve blow energies of around 220 joules in the horizontal plane with the associated fatigue and risk of back injury. Also, hand held pneumatic rock breakers are known, the largest of which provide blow energies of around 100 joules. Because of the recoil, hand held pneumatic rock breakers can only effectively be used vertically down.

Other pneumatic tools are known, such as the percussion tool utilizing negative pressure as disclosed in EP0181486 A (Landmark West Ltd). In this tool a pressure imbalance between a low pressure chamber and a middle chamber creates the force required to accelerate a piston towards a moil. The means by which the impetus is given to the piston is essentially unchanged from a simple pneumatic jackhammer. The force applied to the piston occurs over a short distance of travel, say less than 500 mm, which results in significant reaction forces acting on the tool body and which must be opposed by gravity and by the operator. Furthermore, due to the relatively small size of the low pressure chamber in which a vacuum is created, a significant pressure fluctuation occurs that results in a substantially varied force to the piston. As such the force present in such a tool will vary according to the pressure within the low pressure chamber causing vibration which is undesirable.

Many other pneumatic impact tools are unsuitable for high energy blows. One such pneumatic impact device with recoil damping is disclosed in EP1690647 A (Thyssenkrupp Drauz Nothelfer Gmbh). This device which is used for minimizing vibration on a robot arm during a riveting operation is only suitable for low energy blows. This is particularly evident from the small size of the contact flange 18 shown in FIG. 2. Furthermore the recoil damping in this device occurs after the blow.

Much larger pneumatic recoilless hammers are known, such as the liner bolt removal tool disclosed in International Patent Publication No. WO 2002/081152. This device delivers a 450 joule recoilless blow and weighs 250 kg. In use, it is suspended from above and is manually manipulated. The recoil normally associated with accelerating the hammer piston to strike velocity is absorbed by a much larger free floating mass. This mass is decelerated inside the hammer casing at a rate that is less than the applied force of the operator. Even larger, hydraulic recoilless hammers are known. These hydraulic hammers deliver up to 1500 joule recoilless blows and weigh up to 500 kg, and they are also suspended from above and manually manipulated. The recoil normally associated with accelerating the hammer piston up to strike velocity is absorbed, as in the pneumatic hammer, by a larger mass. In this hammer the larger mass is accelerated forward at a controlled rate prior to the hammer firing. This absorbs the piston acceleration force over a shorter distance.

A disadvantage of the prior art is that the much larger devices that provide blow energies of greater than 150 Joules are considerably heavier than hand held devices. The present invention seeks to provide an alternative recoilless hammer, which can provide blow energies substantially greater than the prior art pneumatic hand held devices, but without the considerable weight disadvantage of the much larger prior art devices.

Within this specification blow energies of less than 150 Joules are considered to be "low blow energies", and blow energies substantially greater than 150 Joules are considered to be "high blow energies".

SUMMARY OF THE INVENTION

According to a first aspect the present invention consists in a pneumatically actuated recoilless hammer comprising:

a first housing;

a moil supported for reciprocal movement along a hammer axis by said first housing;

a piston assembly disposed in an elongate tube extending from the rear of said first housing, the bore of said tube defining a first chamber having a fore end near said first housing and an oppositely disposed closed aft end, said piston assembly moveable within said first chamber such that it may strike said moil, wherein in a rest position the piston assembly is held forward against said moil by a low pressure air supply delivered from a location at or near said aft end of said first chamber, and said piston assembly is retracted to a charged position at said aft end of said first chamber by delivery of high pressure air to act on the fore portion of said piston assembly, and upon actuation of a trigger mechanism by said operator, air is vented from the fore end of said first chamber to atmosphere causing a pressure unbalance of low magnitude across said piston assembly such that it accelerates towards and strikes said moil, and wherein said first chamber is of a length to enable a high energy blow with minimal piston acceleration recoil when said hammer is manually held and operated.

Preferably a cushion assembly surrounds a portion of said moil and is disposed between said moil and said first housing, said cushion assembly comprising a damper cylinder retained within said first housing and a damper sleeve adapted for relative movement between said moil and said first housing.

Preferably an inner damper chamber is disposed between said damper cylinder and said damper sleeve and an outer damper chamber is disposed between said damper cylinder and said first housing, and in use a fluid contained within said inner damper chamber is vented to said outer damper chamber, and the pressure thereby generated within said inner damper chamber acts on said cushion sleeve with the necessary force to bring said moil to a halt.

Preferably in use when said moil impacts an object that is unable to absorb the blow energy imparted thereto, said moil is able to travel forward and cause movement of said damper sleeve which in turn absorbs the blow energy as it moves relative to said damper cylinder.

Preferably in said rest position the piston assembly is held forward against said moil by said low pressure air supply, and in order to operate said hammer an operator must urge said moil against an object to be struck, thereby exerting a force on said piston assembly and said moil backwardly against said low pressure air, thereby sealing egress of air from said first chamber, and upon actuation of a trigger by said operator high pressure air is allowed to enter said first chamber, thereby causing the piston assembly to retract to a charged position.

Preferably said high energy blow is provided by a substantially constant force applied behind said piston assembly during its travel along said first chamber towards said moil.

Preferably said low pressure air supply is stored in an accumulator.

According to a second aspect the present invention consists in a pneumatically actuated recoilless hammer comprising:

a first housing;

a moil supported for reciprocal movement along a hammer axis by said first housing;

a piston assembly disposed in an elongated tube extending from the rear of said first housing, the bore of said tube defining a first chamber having a fore end near said first housing and an oppositely disposed closed aft end, said piston assembly moveable within said first chamber such that it may strike said moil, and wherein said piston assembly being pneumatically actuated such that a substantially constant force is applied behind said piston assembly during its travel along said first chamber towards said moil, and said first chamber is of a length to enable a high energy blow with minimal piston acceleration recoil when said hammer is manually held and operated.

Preferably said high energy blow is provided by a low pressure air supply stored in large external reservoir.

BRIEF DESCRIPTION OF THE DRAWINGS

A preferred embodiment of the invention will now be described, by way of example only, with reference to the accompanying drawings in which.

BEST MODE OF CARRYING OUT INVENTION

Figure 1:
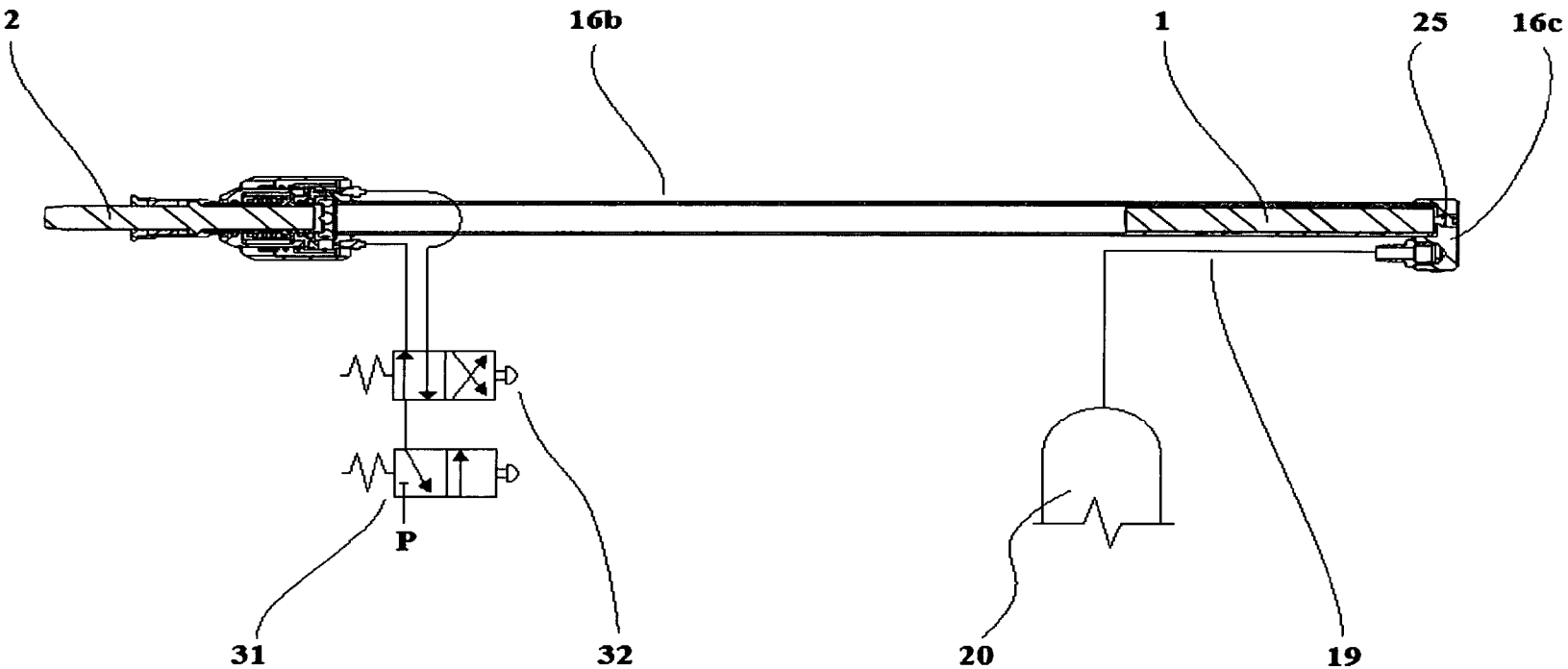
FIG. 1 is a cross-sectional view of an embodiment of a recoilless hammer where the piston is in a charged position in accordance with the present invention. An external accumulator is shown in schematic form.
Figure 2:
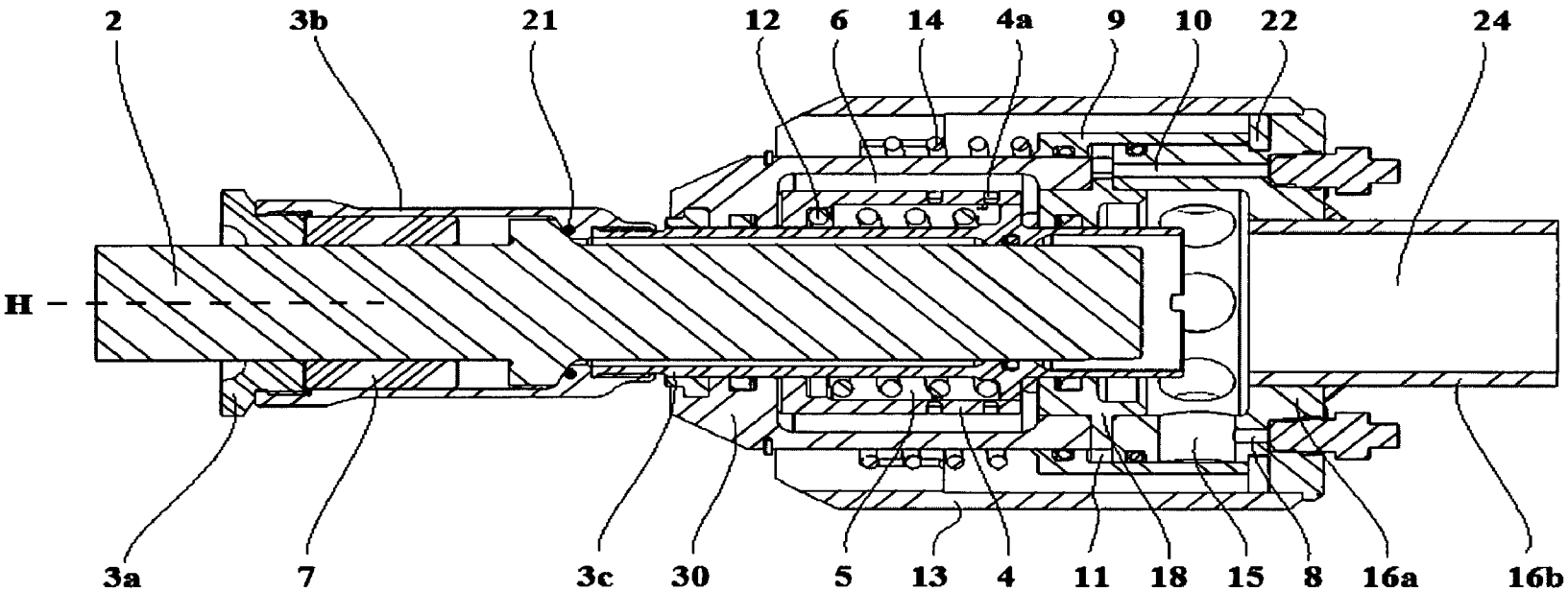
FIG. 2 is an enlarged cross-sectional view of the housing and moil arrangement of the recoilless hammer depicted in circle A of FIG. 1.
Figure 3:
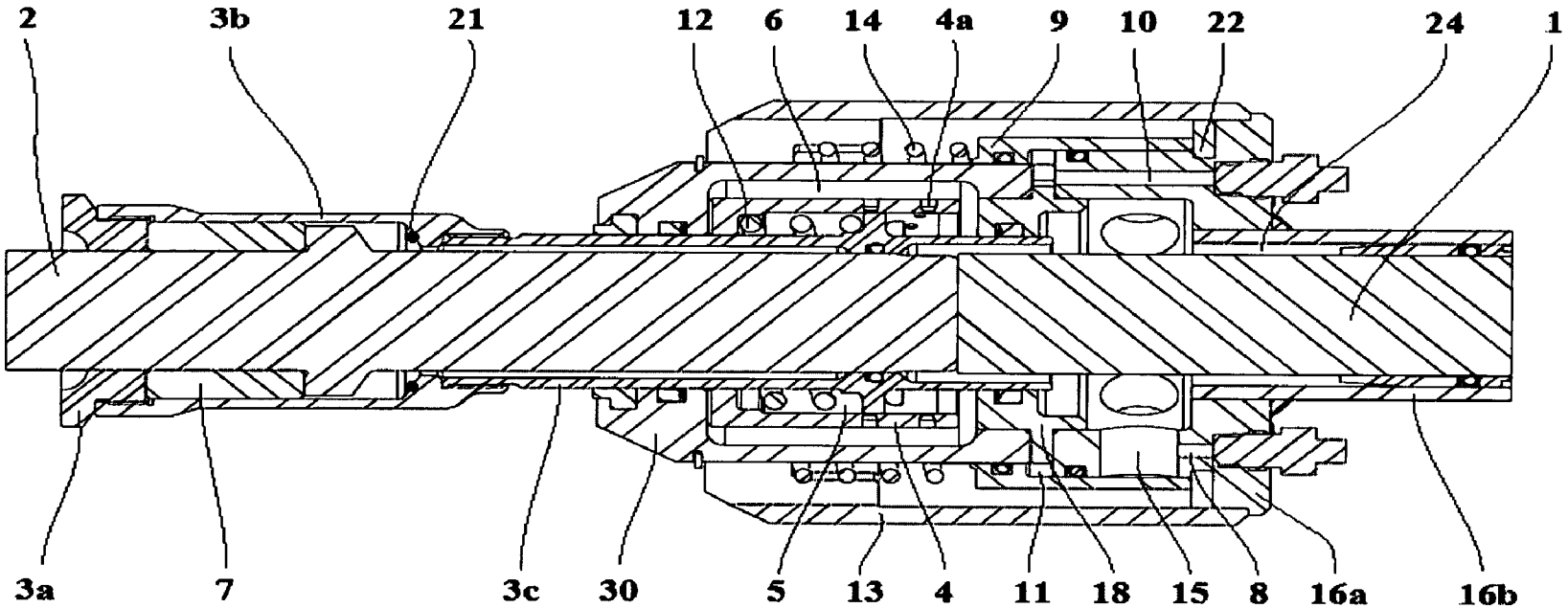
FIG. 3 is an enlarged cross-sectional view of the housing, moil arrangement and piston of the recoilless hammer.

FIGS. 1 to 3 depict an embodiment of a pneumatically actuated recoilless hammer having a main housing 30 for supporting moil 2 near its fore end. A substantially elongate tube (barrel) 16 extends from the rear of main housing 30 via flange 16*a* and intermediate seal retaining plate 18. The bore of tube 16 provides a chamber 24 having a fore end near main housing 30 and an oppositely disposed closed aft end. A cushion 25 and inlet manifold 16*c* is disposed at the closed aft end. A piston (or piston assembly) 1 is disposed within chamber 24 for reciprocal motion therein. Piston 1 is used to strike moil 2, shown in FIGS. 2 and 3, such that moil 2 may be moved along a hammer axis H.

Preferably piston 1 is capable of striking moil 2, such that an object being struck by moil 2 can be imparted with a "high blow energy" of about 250 joules.

A cushion assembly 3 comprises a damper retaining nut 3*a*, buffer housing 3*b* and damper sleeve 3*c*, extends from the fore end of the main housing 30. Buffer housing 3*b* and damper sleeve 3*c* surround a portion of moil 2, with a portion of damper sleeve 3*c* disposed between moil 2 and main housing 30. Cushion assembly 3 also comprises a damper cylinder 4 disposed between damper sleeve 3*c* and main housing 30. Damper sleeve 3*c* is adapted for relative movement between moil 2 and cushion cylinder 4.

Low pressure reservoir 20 supplies constant low pressure air of about 190 kPa to the rear of piston 1, via hose 19 connected to chamber 24 as shown in FIG. 1. The low pressure air reservoir 20 is an accumulator of a significant external volume to allow "blow" to occur with minimal variation in pressure behind piston 1, thereby providing a substantially constant applied force.

In the rest position, the piston 1 is in a forward position as shown in FIG. 3. The moil 2 is forward in the cushion assembly 3 and is held forward by the force of the piston 1 against a buffer 7. The buffer 7 is retained within buffer housing 3*a* by nut 3*b*. Cushion assembly 3 is prevented from moving forwards by the preload exerted by spring 12 located within the cushion.

In use the operator places the moil 2 against the object to be struck; the operator then exerts a force on the hammer forcing piston 1 and moil 2 backwards against the air pressure. When moil 2 reaches the rear limit of travel, moil seal 21 prevents the egress of air from chamber 24 see FIG. 2.

Operation of the valve 31 allows air to flow into chamber 24 through gallery 8. Provided sufficient force is applied by the operator(s), the chamber 24 is sealed allowing high pressure air of about 300 kPa to flow down gallery 8 into chamber 24. This causes piston 1 to retract to the cushion 25 located at the aft end of chamber 24. If the operator stops pushing, seal 21 will allow egress of air to atmosphere through damper sleeve 3*c*, returning the piston to a safe rest position. The requirement to push the piston 1 rearwards against the constant driving pressure existing in the rear portion of chamber 24 to the "travel limit" of moil 2 ensures that the force exerted by the operator during the loading process is the same as that required to resist the acceleration force of the piston during firing. This guarantees that the hammer remains in contact with the item to be struck during the firing process. During charging the pressure in the forward region of chamber 24 should preferably not exceed a value that would produce 250N force on the moil 2.

When piston 1 is in the charged position, the operator triggers a valve 32 venting gallery 8 and supplying compressed air to gallery 10. Air travels into chamber 11 forcing the main valve sleeve 9 forward against spring 14, opening chamber 24 to atmosphere via radial ports 15 and shroud 13. At this point pressure across the piston 1 is unbalanced at "a low magnitude", and the piston accelerates towards moil 2.

When piston 1 strikes moil 2, one of two things happens.

(i) if the object being struck has sufficient resistance, the moil 2 moves forward inside cushion assembly 3 until the object stops, and the cushion assembly 3 remains stationary.

(ii) if the object being struck is not able to absorb the full 250 (or more) joules, moil 2 and piston 1 continue to travel forward until the moil 2 shoulder impacts with the buffer 7 causing damper sleeve 3*c* to travel forward. The inner damper chamber 5 inside the damper cylinder 4 is filled with oil; the damper cylinder 4 contains orifices 4*a* such that oil is vented into the outer damper (low pressure) chamber 6. Sequential restriction of this flow, through time-linear spacing of said orifices, causes the moil 2 and damper sleeve 3*c* to be brought to a stop. The cushion is capable of dissipating the full blow energy of the hammer.

When the operator releases the trigger valve (not shown), compressed air in gallery 10 is vented to atmosphere, allowing main valve sleeve 9 to close and compressed air is supplied to gallery 8. The hammer is now ready for another cycle.

In the present embodiment, it is preferred that the tube 16 having a bore diameter of about 42 mm is sufficiently long enough to provide piston 1 with a travel of about one meter, in order for the hammer to deliver a high blow energy of 250 or more joules. This blow energy is delivered with minimal recoil imparted to the operator because of two primary contributing factors. The first contributing factor is the length of the travel provided to piston 1 within chamber 24 by tube 16. The second contributing factor is the "low magnitude" of the unbalanced force required to accelerate piston 1 towards moil 2. This low magnitude may be in the order of 250 Newtons.

The abovementioned embodiment of a pneumatically actuated recoilless hammer is particularly suited for use as a liner bolt removing tool. Such a tool is used to remove bolts from a mining mill that utilises sacrificial segmented liners bolted to the internal casing of the mill. However, it should be understood that the pneumatically actuated recoilless hammer of the present invention is not limited to such an application, and could be used for many other uses including rock breaking and the like.

In the abovementioned embodiment the operator must exert a force on the hammer forcing piston 1 and moil 2 backwards against the air pressure before the hammer operates. However, it should be understood that in other not shown embodiments, this feature may be achieved by some other way, such as providing a load switch on the handle.

In the abovementioned embodiment, when piston 1 is in the charged position, the operator triggers a valve 32 venting gallery 8 and supplying compressed air to gallery 10. However, in an alternative not shown embodiment, the hammer may have a switch/sensor that automatically triggers this valve venting gallery 8 and supplying compressed air to gallery 10, when piston 1 reaches (or comes near to) the charged position.

In the abovementioned embodiment the accumulator (low pressure reservoir) 20 is external of the hammer. However, it should be understood that in another not shown embodiment the accumulator may be integral with the recoilless hammer.

In the abovementioned embodiment the high pressure is 300 kPa and low pressure is 190 kPa. However, it should be understood that other values of high and low pressure may be used, as long the pressure difference between them is sufficient enough to cause the pressure unbalance. For example, high pressure may be 350 kPa and low pressure may be 250 Kpa.

The terms "comprising" and "including" (and their grammatical variations) as used herein are used in inclusive sense and not in the exclusive sense of "consisting only of".

The invention claimed is:

1. A pneumatically actuated recoilless hammer comprising:

a first housing;

a moil supported for reciprocal movement along a hammer axis by said first housing;

a piston assembly disposed in an elongate tube extending from the rear of said first housing, the bore of said tube defining a first chamber having a fore end near said first housing and an oppositely disposed closed aft end, said piston assembly moveable within said first chamber such that it may strike said moil, wherein in a rest position the piston assembly is held forward against said moil by a low pressure air supply delivered from a location at or near said aft end of said first chamber, and said piston assembly is retracted to a charged position at said aft end of said first chamber by delivery of high pressure air to act on the fore portion of said piston assembly, and upon actuation of a trigger mechanism by an operator, air is vented from the fore end of said first chamber to atmosphere causing a pressure unbalance of low magnitude across said piston assembly such that it accelerates towards and strikes said moil, and wherein said first chamber is of a length to enable a high energy blow with minimal piston acceleration recoil when said hammer is manually held and operated.

2. A pneumatically actuated recoilless hammer as claimed in claim 1, wherein a cushion assembly surrounds a portion of said moil and is disposed between said moil and said first housing, said cushion assembly comprising a damper cylinder retained within said first housing and a damper sleeve adapted for relative movement between said moil and said first housing.

3. A pneumatically actuated recoilless hammer as claimed in claim 2, wherein an inner damper chamber is disposed between said damper cylinder and said damper sleeve and an outer damper chamber is disposed between said damper cylinder and said first housing, and in use a fluid contained within said inner damper chamber is vented to said outer damper chamber, and the pressure thereby generated within said inner damper chamber acts on said cushion sleeve with the necessary force to bring said moil to a halt.

4. A pneumatically actuated recoilless hammer as claimed in claim 3 wherein in use when said moil impacts an object that is unable to absorb the blow energy imparted thereto, said moil is able to travel forward and cause movement of said damper sleeve which in turn absorbs the blow energy as it moves relative to said damper cylinder.

5. A pneumatically actuated recoilless hammer as claimed in any of claims 2 to 4, wherein in said rest position the piston assembly is held forward against said moil by said low pressure air supply, and in order to operate said hammer an operator must urge said moil against an object to be struck, thereby exerting a force on said piston assembly and said moil backwardly against said low pressure air, thereby sealing egress of air from said first chamber, and upon actuation of a trigger by said operator high pressure air is allowed to enter said first chamber, thereby causing the piston assembly to retract to a charged position.

6. A pneumatically actuated recoilless hammer as claimed in claim 1, wherein said high energy blow is provided by a substantially constant force applied behind said piston assembly during its travel along said first chamber towards said moil.

7. A pneumatically actuated recoilless hammer as claimed in claim 6, wherein said low pressure air supply is stored in an accumulator.

8. A pneumatically actuated recoilless hammer comprising:

a first housing;

a moil supported for reciprocal movement along a hammer axis by said first housing;

a piston assembly disposed in an elongated tube extending from the rear of said first housing, the bore of said tube defining a first chamber having a fore end near said first housing and an oppositely disposed closed aft end, said piston assembly moveable within said first chamber such that it may strike said moil, and wherein said piston assembly being pneumatically actuated such that a substantially constant force is applied behind said piston assembly during its travel along said first chamber towards said moil, and said first chamber is of a length to enable a high energy blow with minimal piston acceleration recoil when said hammer is manually held and operated.

9. A pneumatically actuated recoilless hammer as claimed in claim 8, wherein said high energy blow is provided by a low pressure air supply stored in a reservoir.

* * * * *